US005672018A

United States Patent [19]

Yamamoto et al.

[11] Patent Number: 5,672,018

[45] Date of Patent: Sep. 30, 1997

[54] CURL STRAIGHTENING DEVICE FOR STRAIGHTENING CURL OF PRINT PAPER AND TAPE CASSETTE PROVIDED WITH THE SAME

[75] Inventors: Toshiyuki Yamamoto; Takanobu Matsuura, both of Iwate-ken, Japan

[73] Assignee: Alps Electric Co., Ltd., Tokyo, Japan

[21] Appl. No.: 577,404

[22] Filed: Dec. 22, 1995

[30] Foreign Application Priority Data

Dec. 26, 1994 [JP] Japan ..... 6-323254

[51] Int. Cl.[6] ..... B41J 15/00

[52] U.S. Cl. ..... 400/613.3; 271/188

[58] Field of Search ..... 400/613.3, 619, 400/323, 647, 636, 628; 271/188, 161, 209

[56] References Cited

U.S. PATENT DOCUMENTS 4,561,173 12/1985 Ozawa et al. ..... 400/613.3
4,708,333 11/1987 Servi et al. ..... 271/106
4,896,980 1/1990 Sanders, Jr. et al. ..... 400/613.3
4,948,278 8/1990 Schiffmacher et al. ..... 400/248

FOREIGN PATENT DOCUMENTS 3-132377 6/1991 Japan ..... 400/613.3

*Primary Examiner*—Ren Yan
*Attorney, Agent, or Firm*—Guy W. Shoup; Patrick T. Bever

[57] ABSTRACT

A curl straightening device for removing a curl from a paper sheet which is caused during printing by a printer. The curl straightening device includes a supporting platen which supports a curled paper sheet after printing is performed on a first surface of the paper sheet, a carriage which is reciprocatingly movable along the supporting platen, and a pressing member, mounted on the carriage and positioned on an opposite side of the paper sheet from the platen. The pressing member presses against a second surface of the paper sheet as the carriage moves along the platen so as to remove the curl from the paper sheet which is caused by printing on the first surface of the paper sheet.

8 Claims, 2 Drawing Sheets

CURL STRAIGHTENING DEVICE FOR STRAIGHTENING CURL OF PRINT PAPER AND TAPE CASSETTE PROVIDED WITH THE SAME

BACKGROUND OF THE INVENTION

1. Field of the Invention

The present invention relates to a curl straightening device which straightens a curl of a printed paper sheet and a printer including the curl straightening device.

2. Description of the Related Art

In general, various types of printers (such as thermal transfer printers, ink jet printer, and electrophotographic printers, the laser beam type electrophotographic printer being a typical example) are widely used to print characters or diagrams on a recording medium such as plain sheets, OHP (overhead projector) paper sheets, or postcards. The choice of the type of printer, or output device of computers, word-processors, facsimilies, etc., depends on whether they are convenient to use, the printing quality desired, the cost, etc.

Among these types of printers, the thermal transfer printer is in wider use because it is convenient to use and is easy to maintain. A description will be given below, taking the thermal transfer printer as an example.

A general thermal transfer printer includes: (1) a platen, (2) a carriage carrying a ribbon cassette, containing therein an ink ribbon formed by coating ink of a desired color onto a base film, which is reciprocatingly movable along the platen, and (3) a thermal head having a plurality of heating elements arranged in rows which moves into contact with and moves away from the carriage with respect to the platen. With a paper sheet and the ink ribbon supported forwardly of the platen, the ink ribbon is supplied as the thermal head moves reciprocatingly, along with the carriage, in a press-contacted state against the platen, via the paper sheet and the ink ribbon. The plurality of heating elements arranged in rows on the thermal head are selectively heated based on the print information. This melts a portion of the ink of the ink ribbon, which is transferred onto the paper sheet at a predetermined printing position, so that desired images such as characters are printed onto the paper sheet.

However, such a conventional thermal transfer printer has a problem in that the printed paper surface gets curled inwardly, as illustrated in FIG. 1, which occurs when the paper sheet gets drawn as the thermal head moves in a press-contacted state against the platen, or when the moisture on the paper sheet surface is evaporated by the heat of the heating elements. The problem of paper sheet curling becomes more serious for higher print duty (recording density) such as print pattern or print density or for color printing in which an image is superimposed on a previously printed monochromatic image.

In the electrophotographic printer, a printed paper sheet is curled by heat produced during fixing of the toner, whereas in the ink jet printer, a printed paper sheet is curled by, for example, the evaporation of moisture after ink has adhered onto the paper sheet.

When the printed paper sheets are curled to a large extent, the piled printed paper sheets become voluminous, and it becomes difficult to confirm the printed information on the paper sheets and handle the paper sheets.

Accordingly, there has been a demand for a device which can straighten curled printed paper sheets.

SUMMARY OF THE INVENTION

An object of the present invention is to provide a simply constructed curl straightening device which can straighten the curls of the printed paper sheet and to provide a printer including this device.

Another object of the present invention is provide a curl straightening device comprising a supporting platen which supports a printed curled paper sheet, a carriage which can move reciprocatingly along the supporting platen, and a pressing member, provided on the carriage and oppositely of the aforementioned supporting platen, which presses on the curled paper sheet as the aforementioned carriage moves, so as to straighten the curl.

Still another object of the present invention is to provide a curl straightening device in which the aforementioned pressing member is a roller which is rotatably disposed.

Still another object of the present invention is to provide a printer in which the aforementioned curl straightening device is provided at the downstream side of the paper sheet moving direction from the print position.

Still another object of the present invention is to provide a curl straightening device in which a reciprocatingly movable pressing member, provided on the carriage, can be moved while it presses against the reverse side of the printed curled paper sheet surface as the carriage moves, so that the printed curled paper sheet can be curled in the opposite direction, resulting in curl straightening of the paper sheet.

Still another object of the present invention is to provide a curl straightening device in which the reciprocatingly movable pressing member, provided on the carriage, presses against the curled paper sheet as the carriage moves in order to removal the curl, and the pressing member is a rotatable roller, thereby making it possible to increase the wear resistance of the pressing member.

Still another object of the present invention is to provide a printer including the aforementioned curl straightening device into the printer, so that effective straightening of the printed paper sheet can be achieved.

DESCRIPTION OF THE PREFERRED EMBODIMENTS

A description will now be given of an embodiment of the present invention, with reference to the drawings.

Figure 1:
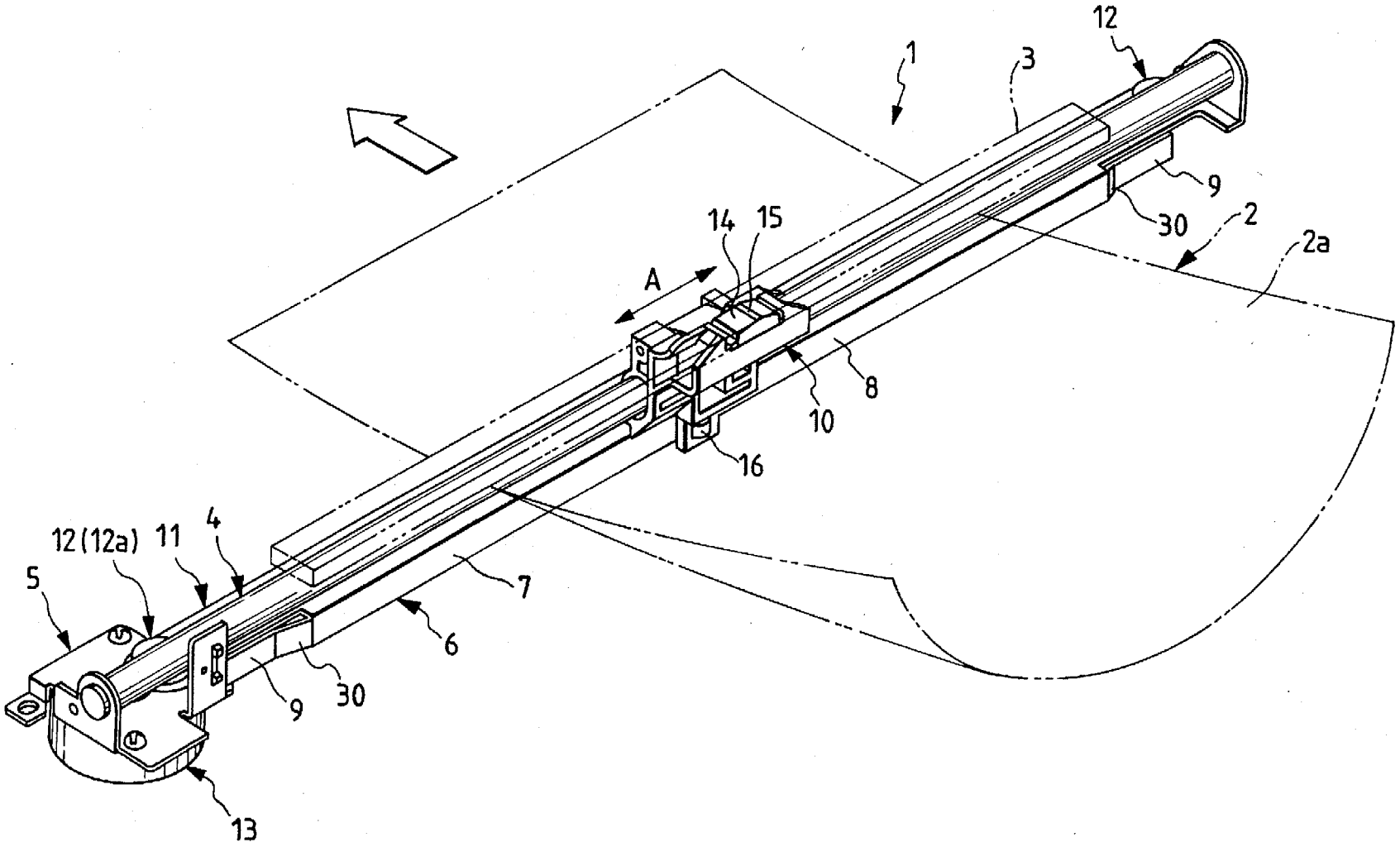
FIG. 1 is a perspective view of a critical portion of a curl straightening device of an embodiment of the present invention.

FIG. 1 is a perspective view of a construction of a critical portion of a curl straightening device of the present invention.

Referring to FIG. 1, in a curl straightening device 1 of the embodiment, a virtually plate-shaped supporting platen 3 which supports a curled paper sheet 2 is mounted to a frame body (not shown), and a guide shaft 4 extends parallel with and below the supporting platen 3. Both ends of the guide shaft 4 are supported by a supporting frame 5, and a virtually plate-shaped guide member 6 is formed forwardly and below the supporting frame 5 such that the guide member 6 extends parallel with the guide shaft 4. The front face of the guide member 6 is a cam face 7 whose central portion along the longitudinal dimension is a protrusion 8 which protrudes out forwardly by an amount greater than the width of the paper sheet. Both ends along the longitudinal dimension of the cam face 7 are recesses 9 which are positioned backwardly of the protruding section 8. The protrusion 8 is joined to each recess 9 through inclined faces 30.

A carriage 10 is slidably mounted onto the guide shaft 4. This carriage 10 has mounted thereto a draw member 11 such as an endless belt, with the draw member 11 wound over two pulleys which are disposed outside the range of movement of the carriage 10 supported by the supporting frame 5. The left pulley 12 of FIG. 1 can be rotationally driven by a motor 13 fixed to the left end and below the supporting frame 5. More specifically, the carriage 10 can move reciprocatingly along the supporting platen 3 along the dimension indicated by arrow A of FIG. 1 when the motor 13 is rotated and driven.

A straightening head 14 is provided at the front side (upper side in FIG. 1) of the aforementioned carriage 10 oppositely of the supporting platen 3. A rotatable roller 15 as a pressing member is provided on the straightening head 14 oppositely of the supporting platen 3. The roller 15 is disposed such that its axis is along a dimension perpendicular the longitudinal dimension of the supporting platen 3. A rotatable guide roller member 16 is provided at the back side (lower side in FIG. 1) of the carriage 10 such that the member 16 moves on the guide member 6, with the movement of the carriage 10. The roller 15 may be directly provided on the front side of the carriage 10.

When the guide roller member 16, provided at the lower side of the carriage 10, is positioned at the protrusion 8 of the cam face 7 of the guide member 6 with the movement of the carriage 10, the roller 15, provided on the straightening head of the carriage 10, is press-contacted against the supporting platen 3. On the other hand, when the guide roller member 16, provided at the lower side of the carriage 10, is positioned at the recess 9 of the cam face 7 of the guide member 6, the roller 15 separates from the supporting platen 3.

The curl straightening device 1 of the embodiment may be provided with a sheet feed mechanism (not shown) which transports curled paper sheet 2 in a direction perpendicular to the longitudinal direction of the supporting platen 3.

In the foregoing description, specific mention has been made of a construction in which guide roller member 16 is provided at the back side of the carriage 10 and guide member 6 has cam face 7 with protrusion 8 and recesses 9, whereby the guide roller member 16 on cam face 7 is moved, so as to cause the roller 15, provided on the front side of the carriage 10, to move into contact and away from the supporting platen 3. However, any construction may be employed as long as it allows roller 15 to move into contact or away from the supporting platen 3, when necessary.

A description will be given of the operation of the device of the embodiment having the above-described construction.

When the curl straightening device 1 of the embodiment is driven and the printed curled paper sheet 2 is waiting to be supplied, the carriage 10 is positioned on either end (for example, the left end) of the guide shaft 4, while the guide roller member 16, provided at the lower side of the carriage 10, is positioned in the recess 9 in the cam face 7 of the guide member 6, so that the roller 15 of the removal head 14, provided on the upper part of the carriage 10 of FIG. 1, separates from the supporting platen.

While the curled paper sheet is in a waiting state, the curled paper sheet 2 which has been printed by any of the various printers (not illustrated) is set such that the print surface 2*a* between the supporting platen 3 and the carriage 10 is opposite the supporting platen 3.

Thereafter, the motor, which is driven, causes the carriage 10 to start moving along the guide shaft 4 to the other end (for example, the right end) of the guide shaft 4. As the carriage 10 moves, the guide roller member 16, provided at the lower side of the carriage 10, moves from the left recess 9 of FIG. 1 formed in the cam face of the guide member 6 to the protrusion 8. When the guide roller member 16 is positioned at the protrusion 8 of the cam face 7 of the guide member 6, the roller 15 of the straightening head 14, provided on the front side of the carriage 10, is opposite the supporting platen 3 and is press-contacted against the supporting platen 3 by a desired press-contacting force (pressing force).

As the carriage 10 moves further toward the left, the roller 15 moves as it presses against and draws the surface opposite a printed surface 2*a* of the paper sheet 2, so as to effect removal of the curled paper sheet 2 set between the supporting platen 3 and the carriage 10, with the roller 15 and the supporting platen 3 in a press-contacted state.

When the carriage 10 arrives at the right end of the guide shaft 4, the guide roller member 16, provided at the lower side of the carriage 10, is positioned in recess 9 in the cam face 7 of the guide member 6, and the roller 15 of the straightening head 14, provided on the front side of the carriage 10, moves away from the supporting platen 3.

The curled paper sheet 2 is transported by a fixed amount in the direction of the thick arrow in the FIG. 1, so that the carriage 10 is moved along the guide shaft 4 from the right end toward the left end of the guide shaft. Subsequently repeating this operation draws the back side of the curled paper sheet 2 by the roller 15.

More specifically, when the reverse side of the paper sheet 2 curled due to printing is drawn by the roller 15, the printed curled paper sheet is curled in the opposite direction which has the effect of canceling the original curl, so that the curl of the printed paper sheet 2 can be easily removed. As a result of this: (1) the piled paper sheets 2 is less voluminous compared to the piled paper sheets in prior art printers, (2) information printed on the paper sheet 2 can be easily confirmed, and (3) the paper sheets can be easily handled.

The extent to which the paper sheet curled by printing needs to be curled in the opposite direction is controlled by the size of the pressing force between the supporting platen 3 and the roller 15 of the straightening head 14, the head 14 being press-contacted against the supporting platen via the paper sheet 2. The rotatable roller 15 as pressing member, brought into contact with the paper sheet 2, is subjected to a load produced by rolling friction, so that the wear resistance of the roller 15 as pressing member is increased. For more effective curl straightening of the printed paper sheet 2 by the curl straightening device 1 of the embodiment, the construction may be such that the roller 15, which is brought into contact with the paper sheet 2, can be heated by heating means (not shown) such as a heater. In addition, the construction may be such that the pressing member (not shown) which slides on the curled paper sheet 2 is an edge-like contact member instead of the roller 15, though the contact member is less resistant to wear.

Only a portion of the roller 15 or pressing member needs to be in contact with the paper sheet 2, which means that the whole outer peripheral face of the roller 15 does not necessarily have to be in contact with the paper sheet 2. However, this is not preferred because when the axis length of the roller 15 is made too long, the contact force is spread. When the axis of the roller 15 is to be made long, the roller 15 should be formed into a drum shape.

A description will now be given of a printer including the curl straightening device of an embodiment of the present invention, with reference to FIG. 2. The same or corresponding structural components as those of the above-described curl straightening device will be given the same reference numerals in the figure, and their descriptions will be omitted.

Figure 2:
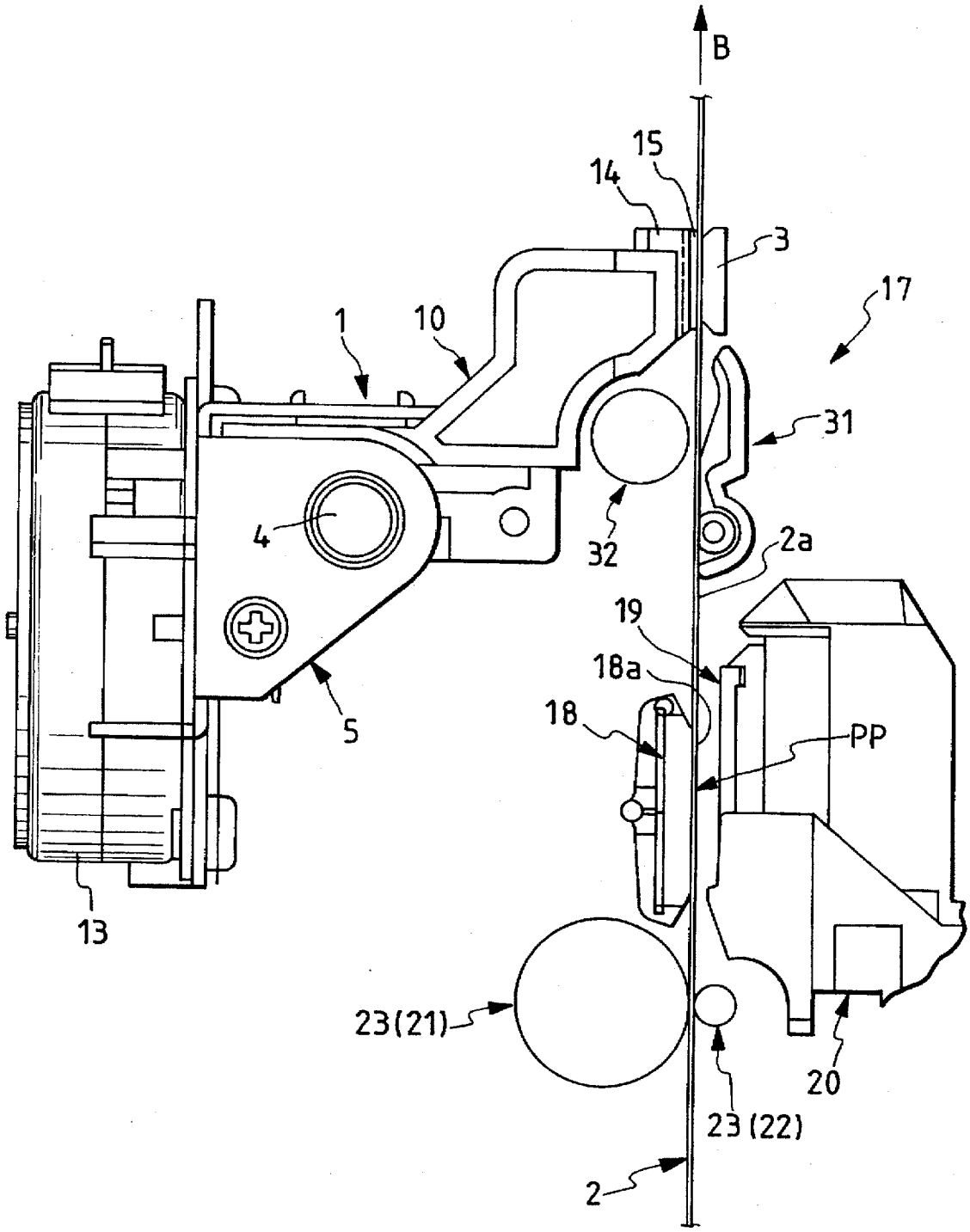
FIG. 2 is illustrative of an arrangement of a critical portion of a printer including a curl straightening device of an embodiment of the present invention.

FIG. 2 is illustrative of a construction of a critical portion of a printer including a curl straightening device of an embodiment of the present invention.

In the embodiment, curl straightening device 1 of the present invention is incorporated in a well known serial-type thermal transfer printer 17.

Referring to FIG. 2, a plate-shaped print platen 18 is disposed in a printer body (not shown) of the thermal transfer printer 17 in the embodiment such that its print surface 18*a* is positioned almost vertically. A thermal head 19 is disposed forwardly (right side in FIG. 2) of and opposite of the print platen 18. The thermal head 19 can freely move into contact and away from the print platen 18 by a drive mechanism (not shown) and has a plurality of heating elements (not shown) which are aligned in rows. In a head-down state (not shown; FIG. 2 illustrates a head-up state), the place of contact of the thermal head 19 and the print platen 18 is defined as the printing position PP. The paper sheet 2 and the ink ribbon (not shown) can be supplied between the print platen 18 and the thermal head 19 from the print platen 18.

The aforementioned thermal head 19 is mounted onto the print carriage 20 which is reciprocatingly movable along the print platen surface by a stepping motor (not shown). A ribbon cassette enclosing the ink ribbon formed by applying ink of a desired color onto a base film (the ribbon and cassette not shown) can be mounted onto the print carriage 20.

A sheet feed roller 21 allows transportation of the paper sheet 2 toward the print position PP at a predetermined speed is provided at the upstream side (lower part of FIG. 2) of the direction toward which the paper sheet 2 moves (in the direction of arrow B in FIG. 2) from the aforementioned print position PP. The sheet feed roller 21 is such as to be rotationally driven by a stepping motor (not shown). An auxiliary roller 22 is rotatably disposed in contact with the outer peripheral face of the paper sheet roller 21 at the right side thereof, with the auxiliary roller 22 being rotationally driven by the paper sheet roller 21. More specifically, the paper sheet 2 can move in the direction of arrow B from the lower part to the upper part of FIG. 2 while it is nipped between the paper sheet roller 21 and the auxiliary roller 21 which compose the paper sheet mechanism 23.

A sheet discharge guide 31 is disposed at the downstream side of the direction toward which the paper sheet 2 moves (in the direction of arrow B in FIG. 2) from the print position PP. The guide 31 is disposed at the side of the printed surface 2*a* of the paper sheet 2 to be discharged to the outside from the print position PP. A sheet discharge roller 32 is disposed virtually opposite the sheet discharge guide 31 via the paper sheet 2, the sheet discharge roller 32 discharging the paper sheets 2 to the outside by being rotationally driven by driving force of a drive motor (not shown).

The support platen 3 is in contact with the printed surface of the paper sheet 2 at the downstream side (upper part of FIG. 2) of the direction toward which the paper sheet 2 moves (in the direction of arrow B in FIG. 2) from the sheet discharge roller 31 and the sheet discharge guide 32. The same curl straightening device 1 as that of the previous embodiment is disposed such that the roller 15 of the removal head 14 is in contact with the reverse side of the print surface 2*a* of the paper sheet 2.

According to the thermal transfer printer 17 of the embodiment having such a construction, with the paper sheet 2 and the ink ribbon supported forwardly of the print platen 18 by the sheet feed mechanism 23, the ink ribbon is supplied as the thermal head (press-contacted against the print platen 18 via the paper sheet 2 and the ink ribbon) and the print carriage 20 are reciprocatingly moved along the print platen 18. A plurality of heating elements, arranged in rows on the thermal head 19, is selectively heated based on the print information. This melts a portion of the ink of the ink ribbon, and the melted ink is transferred onto the paper sheet 2 at a predetermined printing position, so as to form a desired image such as characters onto the paper sheet 2. Then, the paper sheet 2 curled by printing is transported between the supporting platen 3 and the carriage 10 of the curl straightening device 1 sequentially from the sheet discharge guide 31 and the sheet discharge roller 32, after which the carriage 10 of the curl straightening device 1 is moved along the guide shaft 4, so as to allow the roller 15 to draw the reverse side of the printed curled paper sheet 2. This results in straightening of the curl of the printed paper sheet 2 as it is achieved by the above-described curl straightening device. Thereafter, the printed paper sheet 2 in a curl removed state is discharged from the thermal transfer printer 17.

More specifically, according to the thermal transfer printer 17 of the embodiment, the printed paper sheet 2 is discharged in a curl straightened state, so that the curl of the printed paper sheet 2 can be removed efficiently, the piled paper sheets 2 after printing is less voluminous compared to the paper sheet 2 piles in the prior art, the printed information on the paper sheet 2 can be easily confirmed, and the paper sheets can be easily handled.

Obviously, the invention can be applied to various printers such as electrophotographic printers and ink jet printers, although the serial type thermal transfer printer 17 has been specifically mentioned as the printer including the curl straightening device 1 in the foregoing description.

The present invention is not limited to the aforementioned embodiments, so that changes can be made when necessary.

As will be understood from the foregoing description, the curl straightening device of the present invention and the printer including this curl straightening device are highly effective in removing the curls of paper sheets after printing.

What is claimed is:

1. A printer comprising:

a print head located at a print position along a paper feed path along which a paper sheet is conveyed in a paper moving direction such that printing by the print head is applied to a first surface of the paper sheet; and a curl straightening device located adjacent the paper feed path at a downstream side of the moving direction of said paper sheet relative to the print position, the curl straightening device including:

a supporting platen which supports the paper sheet such that the supporting platen contacts the first surface of the paper sheet;

a carriage which is reciprocatively movable along the supporting platen; and a pressing member, provided on the carriage opposite to the platen and positioned to press against a second surface of the paper sheet as the carriage is reciprocated, thereby removing curl from the paper sheet caused by printing on the first surface of the paper sheet.

2. A printer according to claim 1, wherein the pressing member of the curl straightening device is a rotatably disposed roller.

3. A curl straightening device comprising:

a supporting platen which supports a curled paper sheet after printing is performed on a first surface of the paper sheet;

a carriage which is reciprocatingly movable along said supporting platen; and a pressing member, provided on said carriage oppositely of said platen, which presses against a second surface of the paper sheet as said carriage moves so as to remove the curl of said paper sheet caused by printing on the first surface of the paper sheet.

4. A curl straightening device according to claim 3, wherein said pressing member is a rotatably disposed roller.

5. A printer for printing on a paper sheet, the printer comprising:

a first platen;

a first carriage which is reciprocatively movable along the first platen;

a print head mounted on the first carriage;

a second platen;

a second carriage which is reciprocatively movable along the second platen;

a pressing member mounted on the second carriage; and a paper feed path for guiding the paper sheet between the first platen and the first carriage such that printing by the print head is applied to a first surface of the paper sheet, and for guiding the paper sheet between the second platen and the second carriage such that the pressing member presses against a second surface of the paper sheet, the second surface being located on an opposite side of the paper sheet from the first surface.

6. The printer according to claim 5, wherein the paper sheet travels in a downstream direction along the paper feed path, and the pressing member is located downstream along the printing path from a printing position of the print head.

7. The printer according to claim 5, further comprising a guide shaft and an elongated guide member extending parallel to the guide shaft, the guide member including a cam face having a protruding section and a recess; and wherein the second carriage is slidably mounted on the guide shaft;

wherein a guide roller member is mounted on the second carriage such that the guide roller member moves on the guide member in response to movement of the second carriage along the guide shaft, the guide roller member being connected to the pressing member such that when the guide roller member is located in the recess of the cam face, the pressing member is positioned away from the second platen, and when the roller guide member is located on the protruding section of the cam face, the pressing member presses the paper sheet against the second platen.

8. The printer according to claim 5, wherein the pressing member is a roller which is rotatably mounted on the second carriage.

* * * * *